US006866490B2

(12) United States Patent
Daniëls et al.

(10) Patent No.: US 6,866,490 B2
(45) Date of Patent: Mar. 15, 2005

(54) WATER-INJECTED SCREW COMPRESSOR

(75) Inventors: Ivo Daniëls, Boom (BE); Luc Van Mieghem, Kruibeke (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 0 days.

(21) Appl. No.: 10/481,415

(22) PCT Filed: Jun. 14, 2002

(86) PCT No.: PCT/BE02/00098

§ 371 (c)(1),
(2), (4) Date: Dec. 30, 2003

(87) PCT Pub. No.: WO03/006831

PCT Pub. Date: Jan. 23, 2003

(65) Prior Publication Data

US 2004/0151601 A1 Aug. 5, 2004

(30) Foreign Application Priority Data

Jul. 13, 2001 (BE) ..... 2001/0479

(51) Int. Cl.[7] ..... F03C 2/00

(52) U.S. Cl. ..... 418/97; 418/84; 418/85; 418/87; 418/88; 418/201.1; 418/270; 418/DIG. 1; 417/298; 417/441; 184/6.16

(58) Field of Search ..... 418/84, 85, 87, 418/88, 97, 100, 270, DIG. 1, 201.1, 201.2; 417/298, 410.4, 440, 441; 184/6.16

(56) References Cited

U.S. PATENT DOCUMENTS 4,063,855 A * 12/1977 Paul ..... 418/84
4,173,440 A * 11/1979 Libis ..... 418/84
5,171,130 A * 12/1992 Kume et al. ..... 417/228
5,312,235 A * 5/1994 McHugh ..... 418/201.1
5,318,151 A * 6/1994 Hood et al. ..... 418/84
5,531,571 A * 7/1996 Van Dyck ..... 417/282
5,697,763 A * 12/1997 Kitchener ..... 417/28
6,149,408 A * 11/2000 Holt ..... 418/97
6,719,546 B2 * 4/2004 Foerster ..... 418/84

FOREIGN PATENT DOCUMENTS

BE 1012655 A3 * 2/2001 ..... F04C/00/00
DE 2846005 A * 4/1980 ..... F04C/29/02
JP 2000249070 A * 9/2000 ..... F04B/39/16

* cited by examiner

*Primary Examiner*—Theresa Trieu
(74) *Attorney, Agent, or Firm*—Bacon & Thomas, PLLC

(57) ABSTRACT

The invention relates to a water-injected screw compressor which comprises a compressor element (1) with an interior space (3), a suction conduit (7) which connects to an inlet part (6), situated at the top of this interior space (3), a pressure conduit (9) in which a vessel (10) is installed, and an injection conduit (22) between the vessel (10) and the interior space (3), which comprises a part (31) which is situated higher than the upper side of the inlet part (6). A connection conduit (36) is provide between the inlet part (6), on one hand, and a connection point, situated above the maximum water level (35) of the vessel (10), onto the part (32) of this injection conduit (22) extending downward towards its exit, on the other hand.

7 Claims, 1 Drawing Sheet

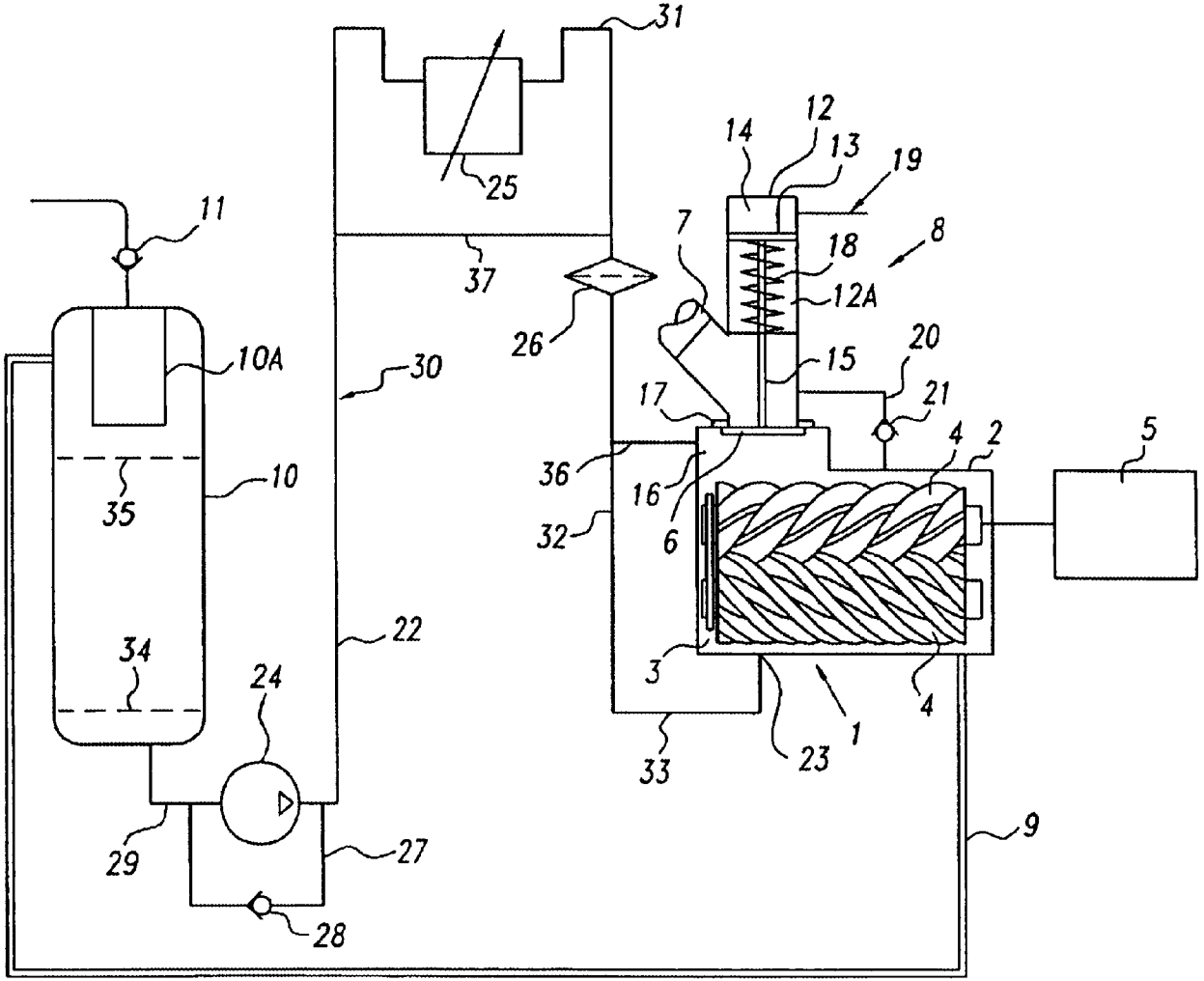
5
9
2
4
4
1
23
3
33
8
20
21
19
18
12A
15
12
13
14
7
17
16
6
31
26
36
32
25
37
30
22
27
28
24
10
10A
11
35
34
29

WATER-INJECTED SCREW COMPRESSOR

This application is the national phase under 35 U.S.C. 5 371 of PCT International Application No. PCT/BE022/00098 which has an International filing date of Jun. 14, 2002, which designated the United States America.

BACKGROUND OF THE INVENTION

This invention relates to a water-injected screw compressor which comprises a compressor element with two rotors driven by a motor, which rotors are rotatable in an interior space of the compressor element, a suction conduit which connects to an inlet part, situated at the top of this interior space of the compressor element, with an inlet valve which can close off the exit giving out to this inlet part, a pressure conduit which connects to this interior space of the compressor element and in which a vessel, which at the same time is a water separator, is installed, whereby an injection conduit is installed between the vessel and the interior space of the compressor element, for the injection of water into this interior space, which injection conduit comprises a part which is situated higher than the upper side of the inlet part of the interior space of the compressor element.

With most of the oil-injected compressors, at the outlet of the compressor element or in the pressure conduit, a valve, mostly a return valve, is provided; a valve is also provided in the injection conduit.

The valve at the outlet prevents that, when the compressor element suddenly stops before the inlet valve is closed, compressed air from the vessel flows outward through the compressor element and the suction conduit.

The valve in the injection conduit prevents that, with a sudden stop, too much oil will flow through the injection conduit into the interior space of the compressor element and this latter would be filled by oil, which subsequently would prevent the starting of the compressor element, as oil is not compressible.

As the functioning of said valves, however, becomes unreliable in a watery environment, the valves at the outlet and in the injection conduit of water-injected compressors mostly are omitted and a special inlet valve is used in the suction conduit, to wit a so-called "unloader".

This "unloader" is a controlled valve mechanism which closes off the inlet just before or immediately after switching off the compressor, such that no compressed gas from the compressor element can be blown towards outside through the suction conduit, and which prevents that, as a result of the pressure in the vessel, the compressor element should be filled with water through the injection conduit. Through this valve mechanism, after stopping, compressed gas can be blown off from the vessel.

When with such compressors, the inlet valve closes off the suction conduit before or immediately after the stop of the compressor element, the vessel and the compressor element are at the same pressure, in consideration of the fact that no return valve is present at the outlet of the compressor element.

At that moment, the water level in the vessel is situated between a minimum and a maximum, and if this water level is higher than the underside of the compressor element, then, as no valve is present in the injection conduit, water from the vessel will flow back to the compressor element, as a result of the suction effect, until the water level in the vessel is equal to the one in the compressor element.

The compressor element can become filled up with water in such a manner that starting becomes impossible.

In order to prevent this, the position of the vessel in respect to the compressor element is chosen such that the maximum water level in the vessel is situated at the height of the bottom side of the rotors in the compressor element.

This may cause problems for the construction of the compressor and has as a consequence that the compressor takes up relatively much space and therefore also the housing in which the vessel, the compressor element and the motor are installed, is relatively large.

SUMMARY OF THE INVENTION

The invention aims at a compressor of the type without valves, neither at the outlet nor in the pressure conduit or in the injection conduit, which does not have this disadvantage and can be realized in a relatively compact manner.

To this aim, according to the invention, a connection conduit is provided between the inlet part of the interior space, on one hand, and a connection point, situated above the maximum water level of the vessel, onto the part of this injection conduit extending downward towards the lower-situated exit of the injection conduit in the interior space, on the other hand.

When a cooler is installed in the injection conduit, which cooler is situated higher than said maximum level, then, in order to prevent a possible draining of the cooler into the interior space, the cooler is situated in a central part of the injection conduit, which, at opposite sides of the cooler, locally rises up to above this cooler, whereas the parts of the injection conduit which connect to this central part and are directed upward, downward, respectively, are connected to each other by means of a connection conduit, below the uppermost point of the injection conduit.

With the intention of better showing the characteristics of the invention, hereafter, as an example without any limitative character, a preferred form of embodiment is described, with reference to the accompanying figure.

BRIEF DESCRIPTION OF THE DRAWINGS

FIG. 1 is schematic view of water-injected screw compressor according to one embodiment of the invention.

DETAILED DESCRIPTION OF THE INVENTION

The water-injected screw compressor represented in this figure comprises a compressor element 1 with a housing 2 which limits an interior space 3 in which two cooperating screw-shaped rotors 4 are rotatably installed, which rotors are driven by a motor 5.

At one extremity, this interior space 3 is provided at the top with an inlet part 6, into which a suction conduit 7 gives out by means of an inlet valve 8.

At the other extremity, at the bottom, a pressure conduit 9 connects to the interior space 3, with therein a vessel 10 which is provided with a filter element 10A and which forms a water separator, and, downstream in respect to the vessel 10, a minimum pressure valve 11.

The inlet valve 8 is a so-called "unloader" and substantially consists of a cylinder-forming housing 12 which is provided with a hollow space 12A in which a piston 13 is displaceable. Between the operative surface of the piston 13 and the housing, a cylinder chamber 14 is formed. At the other side, the piston 13 is connected, by a piston rod 15, to a valve element 16 which is situated in the inlet part 6 and cooperates with a valve seat 17 provided in the wall thereof.

A springy element in the form of a pressure spring 18 surrounds the piston rod 15, between a part of the housing 12 and the piston 13, and pushes the piston 13 away and, therefore, the valve element 16 towards or against the valve seat 17.

A control conduit 19 gives out into the cylinder chamber 14, at the extremity opposed to the valve element 16.

The interior space 3 is in connection with the suction conduit 7 or the interior of the inlet valve 8, upstream of the valve element 16, by means of a conduit 20, with therein a return valve 21 which exclusively allows for a limited flow towards the interior space 3 and prevents the occurrence of a negative pressure in the interior space 3.

An injection conduit 22 connects the underside of the vessel 10 to one or several injection points 23 which give out into the interior space 3.

In this injection conduit 22, starting from the vessel 10, successively a pump 24, a cooler 25 and a water filter 26 are installed.

The pump 24 is bypassed by a conduit 27 with therein a return valve 28 which exclusively allows for a flow from the vessel 10 towards the compressor element 1.

The cooler 25 is installed in a part of the injection conduit 22 which is situated higher than the inlet part 6, and thus this injection conduit 22, between the vessel 10 and the interior space 3, substantially consists of a part 29 situated below the vessel 10, an upward part 30 extending up to above the compressor element 1, a central part 31 with therein the cooler 25, a part 32 extending downward up to below the compressor element 1, and an end part 33 which connects to the interior space 3.

The vessel 10 is provided with a level-measuring device which restricts the level of the water separated in the vessel 10 between a minimum level 34 and a maximum level 35 which is situated just below the inlet part 6.

Besides, this inlet part 6, just above this maximum level 35, is connected, by means of a preferably horizontal connection conduit 36, to the downwardly directed part 32 of the injection conduit 22, whereas this part 32, just above the water filter 26 and thus above the inlet. part 6, however, below the highest point of the injection part 22 and in the represented example even below the cooler 25, is connected to the upwardly directed part 30 of the injection conduit 22 by means of a preferably horizontal connection conduit 37.

When the water-injected screw compressor 1 is switched on, the motor 5 drives the rotors 4. Thereby, air is suctioned through suction conduit 7 and the inlet valve 8 is opened.

In the interior space 3, the suctioned air is compressed, and subsequently the compressed air is fed through the pressure conduit 9 towards the vessel 10, where the water is separated from the air.

During this working, water is injected through the injection conduit 22 into the injection points 23 of the compressor element 1, in order to lubricate and cool the various bearings and the rotors 4. Thereby, this water is cooled in the cooler 25 and filtered in the water filter 26.

The minimum section of the connection conduit 37 is relatively small in respect to the section of the part 32 of the injection conduit 22, and thus also of the part 30 having the same section, such that only a small portion of the water does not flow through the cooler 25.

The connection conduit 36 has a minimum section, for example, the exit to the inlet part 6, which clearly is smaller than the section of the part 32 of the injection conduit 22, such that also only a tiny portion, and preferably less than 5%, of the water is branched off by connection conduit 36 towards the inlet part 6.

As, when starting the compressor, the pressure in the vessel 10 is not high enough, first the pump 24 is also switched on for water injection. As soon as the pressure in the vessel 10 is high enough, the pump 24 is switched off and the water is pressed, by the return valve 28, through the injection conduit 22 as a result of the pressure in the vessel 10.

As soon as the pressure in the vessel 10 surpasses a pressure, which has to be pre-set, of the minimum pressure vessel 11, this latter opens, and compressed air is delivered.

When the compressor is stopped, the inlet valve 8 is closed as a result of the drop of the control pressure through the control conduit 19.

At that moment, the water level in the vessel 10 is between the minimum level 34 and the maximum level 35, whereas the pressure in this vessel 10 is somewhat higher than the pressure set by the minimum pressure valve 11 and which is equal to the pressure at the outlet of the interior space 3. This pressure first will drop by means of the minimum pressure valve 11, and then by means of a blow-off mechanism, not represented in the figure, which is integrated into the the special inlet valve 8 constructed as a so-called "unloader".

If the connection conduit 36 should not be present, due to the suction effect the water level in the vessel 10 and in the interior space 3 should get to an equal level, as the pressure in both spaces is equal.

Due to this connection conduit 36, two pairs of communicating vessels are created, a first pair with the vessel 10 and the interior space 3, which are connected to each other by the connection conduit 36 and the part of the injection conduit 22, situated upstream thereof, comprising the cooler 25, and a second pair of communicating vessels formed by an inlet part 6 and the interior space 3, which are connected to each other by the connection conduit 36 and the part, situated downstream thereof, which comprises the part 33.

Both pairs are trying to find an equilibrium, and air will be suctioned, through connection conduit 36, into the lowermost part of the part 32 of the injection conduit 22, until the level in this part 32 drops up to approximately the bottom side of the interior space 3.

Also, the uppermost portion of the part 32 of the injection conduit 22 can partially drain into the compressor element 1, as the part 32 extends upward towards the cooler 25, up to the highest point of this part 32.

The highest point, where it connects to the central part 31, is situated above the cooler 25 in order to prevent a draining of the latter. At opposite sides of this cooler 25, the central part 31 comprises a part situated higher than the cooler 25.

As a result of the suction effect, the cooler 25 still might drain towards the compressor element 1, by means of the not-selfsuctioning pump, if the second connection conduit 37 were not present.

Due to this connection conduit 37, an air bubble is created in the part 30 of the injection conduit 22, and the water level in this part 30 becomes situated at the same height as the water level in the vessel 10. Above this level, the part 30 is drained.

Due to the connection conduits 36 and 37, the vessel 10 can be situated with its maximum level 35 well above the bottom side of the interior space 3, and, as a result, it can be installed next to the compressor element 1, in the position most advantageous for the construction of the compressor.

In a variant, the connection conduit 36, the final part 33 of the injection conduit 22 and the part, situated below the connection conduit 36, of the part 32 of the injection conduit 22 can be integrated in the housing 2 of the compressor element 1.

The present invention is in no way limited to the form of embodiment described as an example and represented in the figures, however, such water-injected screw compressor can be realized in different forms and dimensions, without leaving the scope of the invention.

What is claimed is:

1. Water-injected screw compressor which comprises a compressor element (1) with two rotors (4) driven by a motor (5), which rotors are rotatable in an interior space (3) of the compressor element (1), a suction conduit (7) which connects to an inlet part (6), situated at the top, of this interior space (3) of the compressor element (1), with an inlet valve (8) which can close off the exit giving out onto this inlet part (6), a pressure conduit (9) which connects to this interior space (3) of the compressor element (1) and in which a vessel (10), which at the same time is a water separator, is installed, whereby an injection conduit (22) is installed between the vessel (10) and the interior space (3) of the compressor element (1), for the injection of water into this interior space (3), which injection conduit (22) comprises a central part (31) which is situated higher than the upper side of the inlet part (6) of the interior space (3) of the compressor element (1), wherein a connection conduit (36) is provided between the inlet part (6) of this interior space (3), on one hand, and a connection point, situated above the maximum water level (35) of the vessel (10), onto a downwardly directed part (32) of this injection conduit (22) extending downward towards the lower situated exit of this injection conduit (22) in the interior space (3), on the other hand.

2. Water-injected screw compressor according to claim 1, wherein the connection conduit (36) has a smaller section than the section of the downwardly extending part (32) of the injection conduit (22).

3. Water-injected screw compressor according to claim 1, wherein the connection conduit (36) extends approximately horizontal.

4. Water-injected screw compressor according to claim 1, wherein it comprises a cooler (25) in the injection conduit (22) which is situated higher than the aforementioned maximum water level (35) and, in order to prevent a possible draining of the cooler (25) towards the interior space, the cooler (25) is situated in the central part (31) of the injection conduit (22), which, at opposite sides of the cooler (25), locally rises up to above this cooler (25), whereas upwardly and downwardly directed parts (30, 32) of the injection conduit (22) which connect to this central part (31) and, are connected to each other by a second connection conduit (37), below the uppermost point of the injection conduit (22).

5. Water-injected screw compressor according to claim 4, wherein the second connection conduit (37) between the parts (30, 32), extending upward, downward, respectively, of the injection conduit (22) is situated above the maximum level (35).

6. Water-injected screw compressor according to claim 5, wherein of the second connection conduit (37) between the upwardly and downwardly directed parts (30, 32) of the injection conduit (22) has a minimum section which is smaller than the minimum section of the portions of the parts (30, 32) to which the connection conduit (37) connects.

7. Water-injected screw compressor according to claim 5 wherein the second connection conduit (37) between the upwardly and downwardly directed parts (30, 32) of the injection conduit extends approximately horizontal and is situated above the connection conduit (36).

* * * * *